US006113422A

United States Patent [19]

Somerville et al.

[11] Patent Number: 6,113,422

[45] **Date of Patent: *Sep. 5, 2000**

[54] CONNECTOR WITH CIRCUIT DEVICES AND INDICATORS

[75] Inventors: James A. Somerville, Hershey; Yakov Belopolsky, Harrisburg, both of Pa.; Gary J. Oleynick, Encinitas, Calif.

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/846,699

[22] Filed: Apr. 30, 1997

Related U.S. Application Data

[60] Continuation-in-part of application No. 08/597,072, Apr. 19, 1996, Pat. No. 5,687,478, which is a division of application No. 08/346,640, Nov. 30, 1994, Pat. No. 5,599,209

[60] Provisional application No. 60/022,973, Aug. 2, 1996.

[51] Int. Cl.[7] ..... H01R 3/00

[52] U.S. Cl. ..... 439/490; 439/620

[58] Field of Search ..... 439/490, 488, 439/620, 676, 910

[56] References Cited

U.S. PATENT DOCUMENTS

| | | | |
|---|---|---|---|
| 3,422,394 | 1/1969 | Antes | 339/176 |
| 4,109,986 | 8/1978 | Mouissie | 339/17 L |
| 4,461,522 | 7/1984 | Bakermann et al. | 339/17 M |
| 4,701,002 | 10/1987 | Mouissie | 439/426 |
| 4,726,638 | 2/1988 | Farrar et al. | 439/620 R |
| 4,772,224 | 9/1988 | Talend | 439/607 |
| 4,978,317 | 12/1990 | Pocrass | 439/490 |
| 5,015,204 | 5/1991 | Sakamoto et al. | 439/620 |
| 5,069,641 | 12/1991 | Sakamoto et al. | 439/620 |
| 5,239,748 | 8/1993 | Hamilton | 29/843 |
| 5,399,107 | 3/1995 | Gentry et al. | 439/676 |
| 5,403,207 | 4/1995 | Briones | 439/620 |
| 5,456,619 | 10/1995 | Belopolsky et al. | 439/620 |
| 5,599,209 | 2/1997 | Belopolsky | 439/676 |
| 5,613,873 | 3/1997 | Bell, Jr. | 439/490 |
| 5,639,266 | 6/1997 | Patel | 439/676 |
| 5,647,767 | 7/1997 | Scheer et al. | 439/620 |
| 5,741,152 | 4/1998 | Boutros | 439/490 |
| 5,876,239 | 3/1999 | Morin et al. | 439/490 |

FOREIGN PATENT DOCUMENTS 0 740 370 A1 10/1996 European Pat. Off. .

OTHER PUBLICATIONS

Ledtronics Publication Entitled: RJ45 Indicator LED's, Jul., 1994.

*Primary Examiner*—Gary F. Paumen

*Attorney, Agent, or Firm*—Brian J. Hamilla; M. Richard Page

[57] ABSTRACT

A console including an electrical connector adapted to be mounted on a printed circuit board (PCB) comprising a base member mounted on the PCB, an insert member mounted on the base member, a jack member engaging said insert member and a component member positioned on the base member remotely from said insert member and said jack member.

17 Claims, 4 Drawing Sheets

CONNECTOR WITH CIRCUIT DEVICES AND INDICATORS

This application claims benefit of Provisional application Ser. No. 60/022,973 filed Aug. 2, 1996, which is a continuation-in-part of U.S. application Ser. No. 08/597,072, filed Apr. 19, 1996, now U.S. Pat. No. 5,687,478, which is a division of U.S. application Ser. No. 08/346,640, filed Nov. 30, 1994, now U.S. Pat. No. 5,599,209.

BACKGROUND OF THE INVENTION

1. Field of the Invention

This invention relates to electrical connectors and particularly to connector modules incorporating diverse elements including signal conditioning components and/or visual indicators. The invention has particular adaptability to modular jacks.

2. Brief Description of Prior Developments

At present, connectors such as modular jacks are usually mounted onto a circuit board forming a part of the electronic device for which the modular jack is an input/output connection. The terminals of the jack are usually electrically connected to surface traces on the circuit board by through-hole or surface mount soldering techniques. The circuit traces in turn lead to discrete signal processing elements such as low pass filters, common mode chokes, isolation transformers and other inductors to process electronic signals provided to or from the jack. Such signal conditioning elements are necessary to accommodate ever increasing signal rates achieved in telecommunications and data transmission networks.

Developers of network systems and the like have expressed a desire to have the line status of an array of such modular jacks independently indicated for each jack. The usual way of accomplishing this is to provide a series of LEDs on the circuit board, with light transmitting elements for carrying light from the LED to a portion of the face plate of the device in which the array of jacks is mounted. Because the LEDs are considered relatively electrically noisy, they are usually mounted on an electrically isolated, separately grounded portion of the circuit board. In turn, this results in the visual indicators being separated from the jacks. This separation causes the determination of line status for an array of jacks to be made more difficult.

SUMMARY OF THE INVENTION

The present invention comprises a console including an electrical connector adapted to be mounted on a printed circuit board (PCB) comprising a base member mounted on the PCB, an insert member mounted on the base member, a jack member engaging said insert member and a component member positioned on the base member remotely from said insert member and said jack member.

BRIEF DESCRIPTION OF THE DRAWINGS

The present invention is further defined by the accompanying drawings in which.

DETAILED DESCRIPTION OF THE PREFERRED EMBODIMENTS

Some effort has been made to make the LEDs integral with the housing of the modular jack, but this is considered undesirable because of electrical noise considerations. To avoid compromising the signals, the LEDs are separately mounted from the signal conditioning elements.

Figure 1:
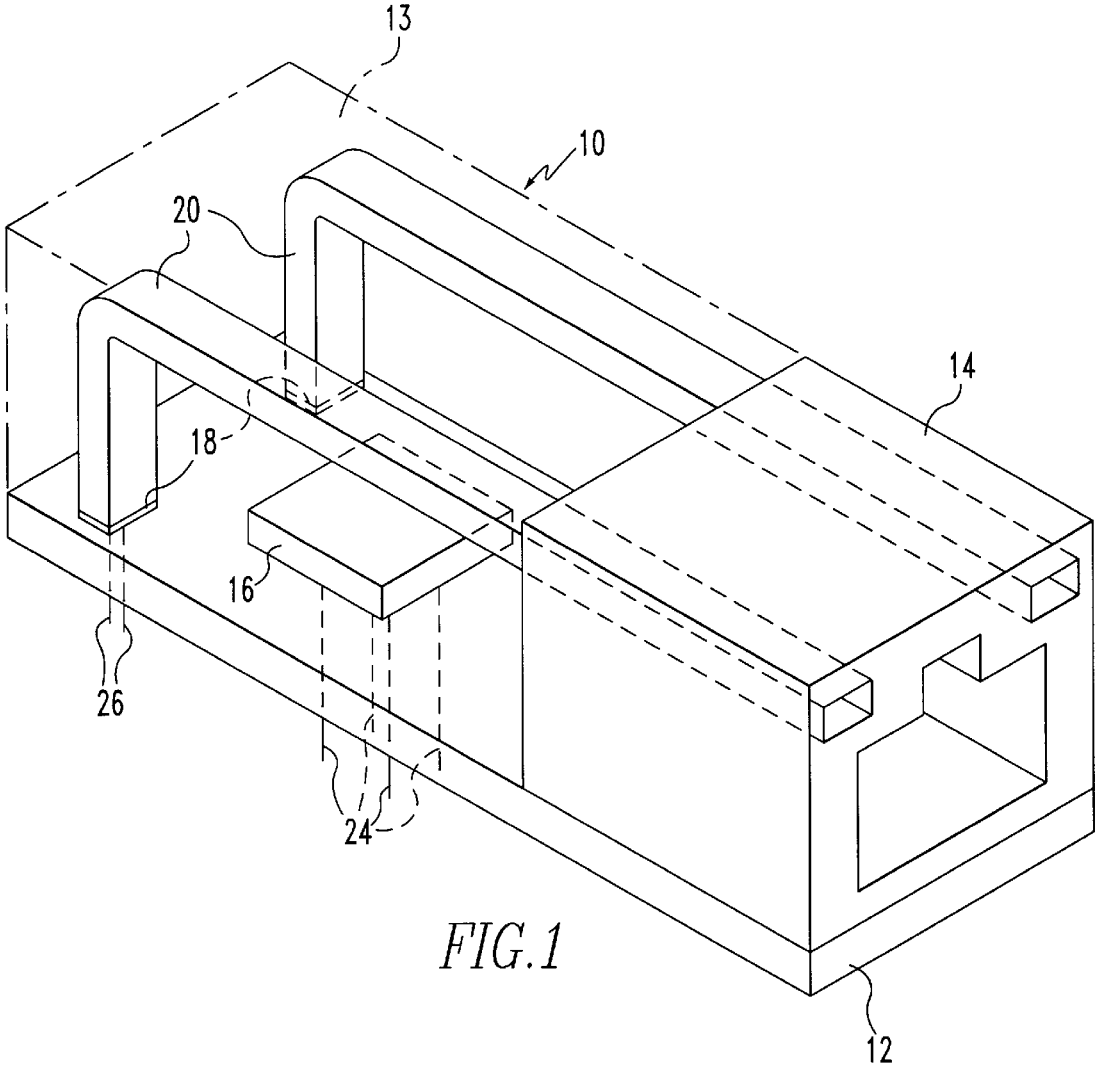
FIG. 1 is an isometric view of one embodiment of the connector module of the present invention.

FIG. 1 shows an isometric view of a connector module according to the invention. The module 10 includes a base member 12, which can comprise a printed circuit board, a lead frame or other mounting substrate. A connector 14 is mounted on the printed circuit board 12 and can comprise a modular jack, such as an RJ 45 jack. The housing of the jack 14 has a cavity for receiving a plug and has contact terminals disposed within the cavity for mating with terminals on the plug. Tail ends of the terminals are electrically connected, as by soldering, to traces (not shown) on the printed circuit board 12.

In order to electrically quiet or otherwise condition signals provided to or received from the jack 14, suitable electrical components, represented by the component 16, are mounted on the printed circuit board. Such elements commonly comprise filters, common mode chokes, isolation transformers, etc. One or more light sources, such as LEDs 18, are mounted on the printed circuit board 12 in a manner electrically isolated from the components 16. Light from the LEDs is transmitted to the front face of the jack 14 by suitable light conductors, such as plastic fibers 20. The fibers 20 extend from the LEDs, through the housing of the jack 14, to the front face of the jack. In this fashion, a visual indication of desired information, such as line status, can be indicated directly on the front face of each jack.

As added protection to the components mounted on the printed circuit board 12 behind the connector 14, an over-molded material or encapsulate 13 or a metal shield can be applied to the printed circuit board 12. This results in a one-piece connector module that can be mounted on a printed circuit board (not shown), through an appropriate I/O pin arrangement 24 that separates noise bearing lines from quiet lines and provides for connection to quiet and noisy ground planes. Suitable pins 26 are provided for LEDs 18. Thus, a single connector module 10 can be provided that easily and quickly mounts onto a base circuit board without the need for mounting separate electrical components and/or visual signal elements.

Figure 2:
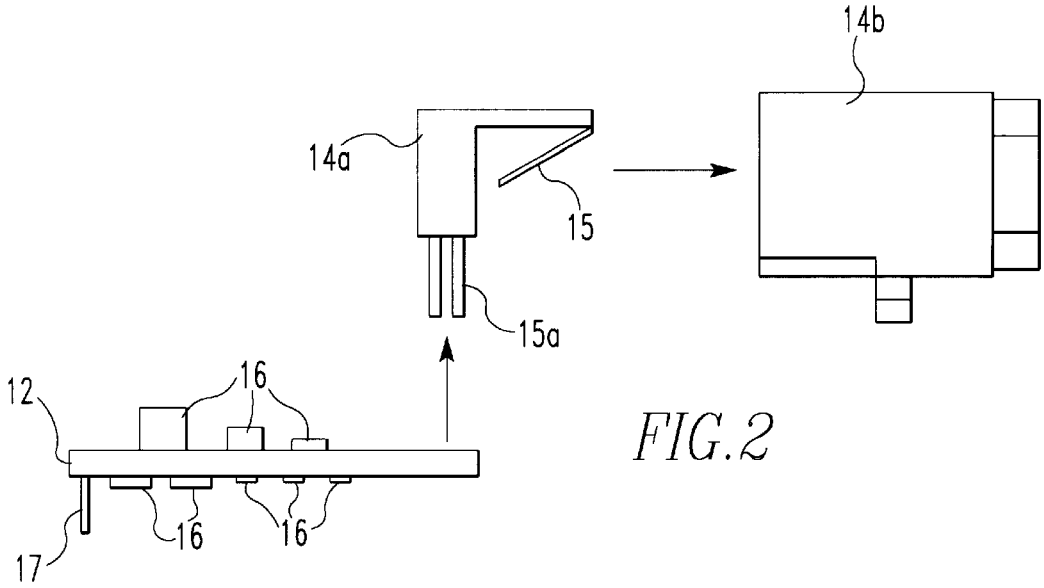
FIG. 2 is an exploded view of a connector module.

FIG. 2 illustrates the construction of a connector module, without a visual indicator, and utilizing an available type of modular jack. In this arrangement, the jack 14 comprises an inverted L-shaped insert 14*a* that carries the jack terminals 15. The terminal tails 15*a* are through-hole mounted on the printed circuit board 12. The insert 14*a* is slidably received in the housing 14*b* of the jack. Desired electrical components 16 are mounted on the printed circuit board 12 and are encapsulated or shielded so that the board 12, jack 14 and encapsulant form a single module. Electrical signals are passed to and from the module by signal pins 17 that are received in the printed circuit board (not shown) on which the module is mounted.

Figure 3:
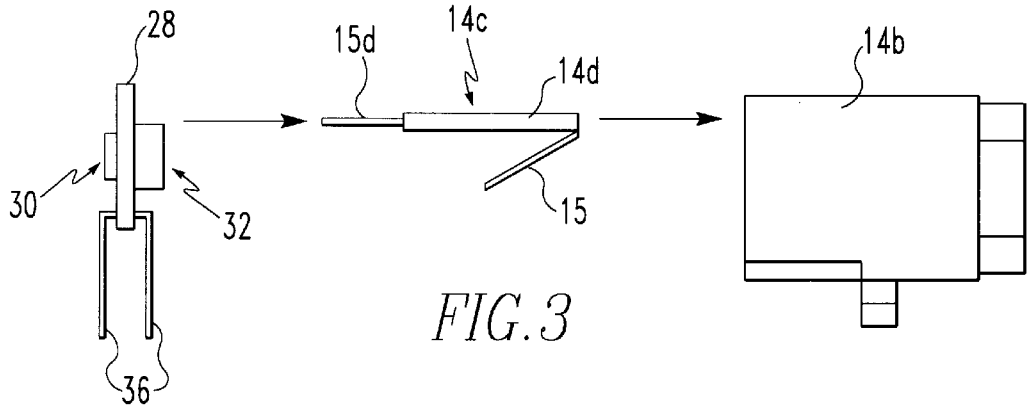
FIG. 3 is an exploded view of another embodiment of a connector module according to the invention.
Figure 4:
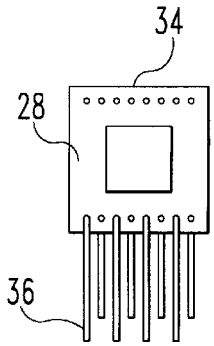
FIG. 4 is an elevational view of an element of the module shown in FIG. 3.

FIG. 3 shows the elements of a connector module with which space requirements are minimized. In this embodiment, the modular jack includes a housing 14*b* in which is received a terminal insert 14*c* comprising an insulative carrier 14*d* and the terminals 15. In this embodiment, the terminal tails 15*d* extend directly beyond the carrier 14*d*. The carrier 14*d* is designed to be mounted by sliding into suitable grooves within the housing 14*b*. For this module, a small circuit board 28 formed of a suitable circuit board material, such as FR-4, is sized to fit within the rear portion of the jack housing 14*b*. Appropriate electronic components such as the common mode choke 30 and the isolation transformer 32 are mounted on one or both sides of the board 28. Signal leads 36 extend from the board 28 in the usual I/O pattern.

This module shown in FIG. 3 is constructed by mounting the circuit elements 30 and 32 and the contact pins 36 on the board 28. The jack terminal insert 14*c* is then mounted on the board 28 with the terminal ends 15*d* of the terminals 15 extending through conductive holes in 34 along the upper edge of the board 28. The thus assembled unit is then inserted within the housing 14*b* to form an integral connector module.

Figure 5:
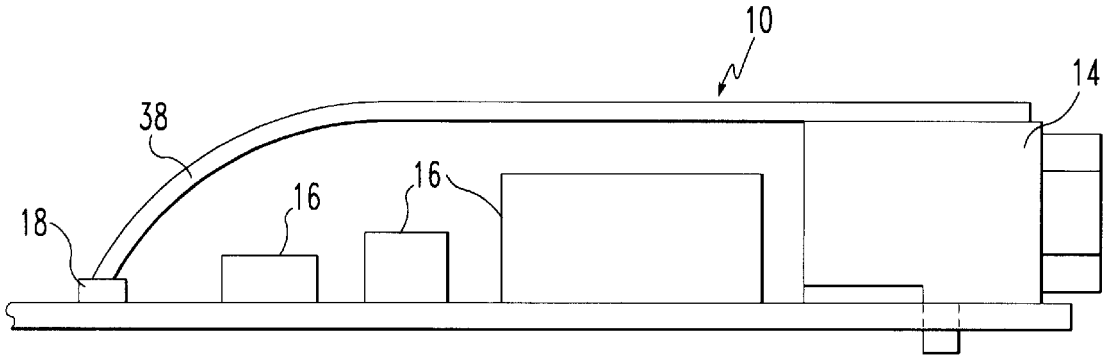
FIG. 5 is a side view of another embodiment of the connector module of the present invention including visual indicators.
Figure 6:
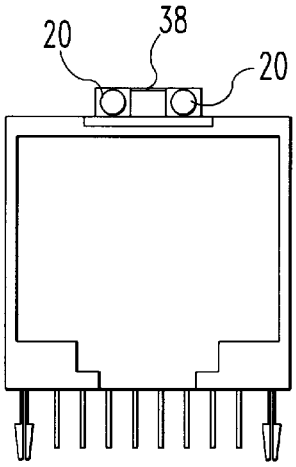
FIG. 6 is a front view of the modular jack used in the connector module shown in FIG. 5.

FIG. 5 illustrates a side elevational view of a module generally of the type shown in FIG. 1. In this arrangement, the plastic light fibers 20 are carried in a common light fiber assembly 38. The light fiber assembly 38 is fixed by appropriate means, such as an adhesive, onto the top or into the housing of the jack 14. Placing the light fibers 20 into an assembly 38 can impart sufficient structural strength so that the need for an encapsulant becomes less important. Also, a module of the type shown in FIG. 3 could be utilized in which the components 16 are essentially housed within the jack housing 14 as in the FIG. 3 embodiment. In this case, the LEDs 18 can be placed physically closer to the jack 14, but preferably remain electrically isolated therefrom. In such an arrangement, the element 38 can be significantly shortened.

Figure 7:
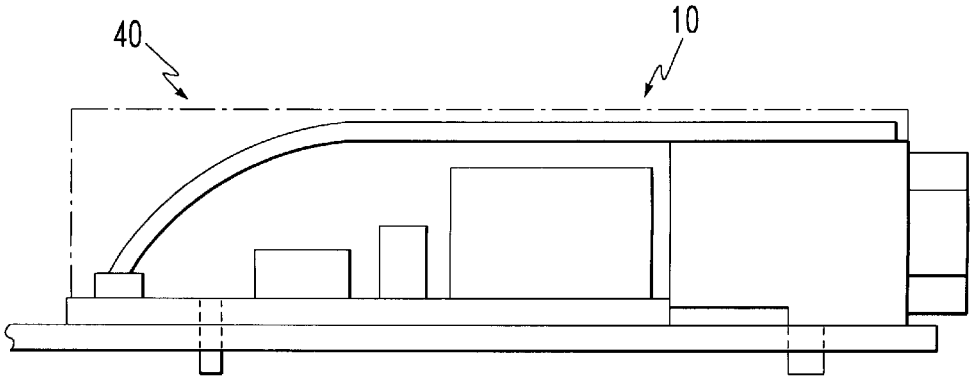
FIG. 7 is an embodiment of the module shown in FIG. 5 with a shield applied.

Referring to FIG. 7, if desired, the module 10 can be provided with additional EMI shielding capabilities by enclosing the top, side and rear surfaces and also the front surfaces with a metal shield 40.

Figure 9:
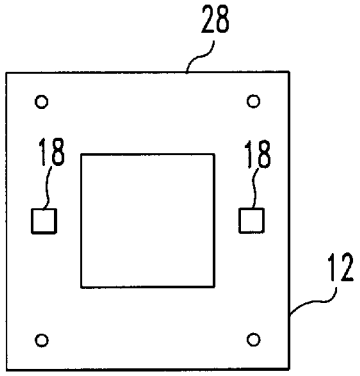
FIG. 9 is a front elevation of the insert shown in FIG. 8.
Figure 8:
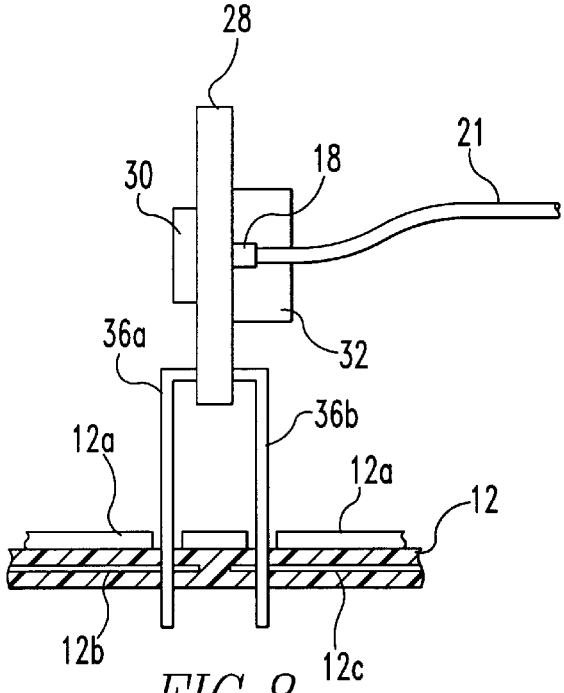
FIG. 8 is a side view of a modified version of the module illustrated in FIG. 3.

FIG. 8 shows a modification to the module illustrated in FIG. 3. In this embodiment, LEDs 18 are mounted on board 28 and light pipes 21 carry the light to the front face of jack housing. The jack is mounted on a circuit board 12 that includes signal traces 12*a* and at least two separated ground planes, one a "noisy" ground plane 12*b* and the other a quiet ground plane 12*c*. A terminal 36*a* provided for one or both of LEDs 18 is connected to the noisy ground plane 12*b*. A terminal 36*b* is provided for connection of the signal conditioning components of board 28 to the quiet ground plane 12*c*. FIG. 9 shows the mounting of LEDs 18 on board 28.

The advantages of the disclosed system arise from providing a self contained module that provides necessary signal conditioning and/or visual indication functions. Such units increase the efficiency of the assembly process of equipment employing such components, as they eliminate the need for separately mounting the connector and associated components onto the circuit board. The components will provide desired signal quality and can also provide desired visual indications of status.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A module including an electrical connector adapted to be mounted on a printed circuit board (PCB) comprising:

(a) a base member adapted to be superimposed on the PCB in parallel side by side relation;

(b) a jack member having a housing with an insert receiving opening and a plurality of conductive contacts;

(c) at least one light emitting diode (LED) mounted on the base member and positioned a distance away from said jack member to generally isolate said contacts from interference by said LED;

(d) a light conductor connecting the LED and the front side of the jack; and (e) an insert member engaging the jack member.

2. The module of claim 1 which is contained within an encapsulant.

3. The module as recited in claim 2, wherein a portion of said base member extends from said jack member, and said encapsulant encloses said portion.

4. A module including an electrical connector adapted to be mounted on a printed circuit board (PCB) comprising:

(a) a base member;

(b) a jack member having a front face mounted on said base member;

(c) an insert member engaging said jack member;

(d) a light emitting diode (LED) positioned on said base member remotely from said insert member and said jack member;

(e) a light conductor connecting said LED with said face of said jack member to provide a visual indication of line status;

(f) a signal conditioning element positioned on said base member remotely from said jack member and said LED; and (g) an encapsulant at least partially enclosing said module.

5. The module of claim 4 wherein the insert member has a plurality of conductive contacts and the jack member has a plurality of conductive contacts and said insert member contacts engage the jack member conductive contacts.

6. The module of claim 4 wherein the base member is superimposed over the PCB in parallel side by side relation.

7. The module of claim 4 wherein the insert has a vertical section and a horizontal section and the horizontal section is inserted into the housing of the jack member and the vertical section removably engages the base member.

8. The module of claim 4 wherein the signal conditioning element is a low pass filter.

9. The module of claim 4 wherein the signal conditioning element is a common mode choke.

10. The module of claim 4 wherein the signal conditioning element is an isolation transformer.

11. An electrical connector assembly mountable on a substrate, comprising:

a circuit substrate mountable on the substrate;

an electrical connector mounted to said circuit substrate, said connector having a front face with an opening for receiving a mating connector;

a light emitter mounted to said circuit substrate a distance away from said connector; and a light conductor spanning between said light emitter and said front face to provide a visual indication at said front face;

wherein said distance prevents said light emitter from interfering with signals in said connector.

12. The electrical connector assembly as recited in claim 11, further comprising a signal conditioning device mounted to said circuit substrate between said connector and said light emitter.

13. The electrical connector assembly as recited in claim 11, wherein said light conductor comprises a fiber.

14. The electrical connector assembly as recited in claim 13, wherein said fiber is a plastic fiber.

15. The electrical connector assembly as recited in claim 11, further comprising an encapsulant enclosing said light emitter and said light conductor.

16. The electrical connector assembly as recited in claim 15, wherein said encapsulant is an overmold.

17. The electrical connector assembly as recited in claim 11, further comprising a shield mounted to said circuit substrate.

* * * * *